US006474087B1

(12) United States Patent
Lifson

(10) Patent No.: US 6,474,087 B1
(45) Date of Patent: Nov. 5, 2002

(54) METHOD AND APPARATUS FOR THE CONTROL OF ECONOMIZER CIRCUIT FLOW FOR OPTIMUM PERFORMANCE

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/969,330

(22) Filed: Oct. 3, 2001

(51) Int. Cl.[7] ..... F25B 41/00; F25B 5/00

(52) U.S. Cl. ..... 62/199; 62/513

(58) Field of Search ..... 62/513, 113, 199, 62/200, 217, 222, 223, 224

(56) References Cited

U.S. PATENT DOCUMENTS

| | | | | | |
|---|---|---|---|---|---|
| 4,696,168 | A | * | 9/1987 | Woods et al. | 62/200 |
| 5,095,712 | A | * | 3/1992 | Narreau | 62/113 |
| 6,032,472 | A | * | 3/2000 | Heinrichs et al. | 62/199 |
| 6,047,556 | A | * | 4/2000 | Lifson | 62/196.2 |
| 6,058,729 | A | * | 5/2000 | Lifson et al. | 62/217 |
| 6,138,467 | A | * | 10/2000 | Lifson et al. | 62/217 |
| 6,202,438 | B1 | | 3/2001 | Barito | |

* cited by examiner

*Primary Examiner*—Denise L. Esquivel
*Assistant Examiner*—Marc Norman

(57) ABSTRACT

The economizer flow to the intermediate compression chamber inside a compressor is controlled via a variable restriction. The size of the restriction is selected to optimize unit performance in relation to operating conditions.

11 Claims, 3 Drawing Sheets

METHOD AND APPARATUS FOR THE CONTROL OF ECONOMIZER CIRCUIT FLOW FOR OPTIMUM PERFORMANCE

BACKGROUND OF THE INVENTION

An economizer consists of a flash tank or heat exchanger with an associated dedicated expansion device and piping. It is located in a refrigeration circuit downstream of the condenser. In the case of the heat exchanger, as is specifically disclosed, the flow upstream of the economizer circuit is divided with a minor portion of the condensed refrigerant flow passing through an expansion device thereby undergoing a pressure drop and partially flashing as it passes into the economizer heat exchanger. In the economizer heat exchanger, the remaining liquid refrigerant evaporates due to heat transfer with the major portion of the condensed refrigerant which is further cooled, thereby increasing the cooling capacity of the unit. The gaseous minor flow is at an intermediate pressure and can pass to the compressor, to cool the motor, or it may be supplied directly to intermediate compression volumes in the compressor to increase the mass of refrigerant being compressed.

SUMMARY OF THE INVENTION

Because the economizer flow line leading to the compressor is connected to a variable pressure inside the intermediate compression volumes, the flow may go back and forth as the intermediate compression volume pressure changes. The present invention places a variable restriction in the economizer line supplying the intermediate compression volumes which may be trapped volumes, as in a positive displacement compressor, or interstage for a multiple stage compressor. The size of the restriction affects the efficiency and capacity of the economized cycle. However, the optimum restriction size varies with operating conditions. For example, for higher pressure ratio applications the optimal size of the restriction or injection port is larger than for lower pressure ratio applications. The present invention varies the size of the restriction as a function of compressor operating conditions to maximize the unit operating efficiency or capacity. Additionally, there is also an optimum size of the restriction or injection port for maximum unit capacity and the opening would be larger if the unit is optimized for maximum capacity rather than for maximum efficiency operation.

In some refrigeration systems, such as transport refrigeration, the temperature is very precisely controlled and may be held to 0.1° C. Accordingly, in such systems, the suction and discharge temperatures and/or pressures are monitored in addition to the zone temperatures etc. and provide the necessary information for controlling the size of the restriction or injection port.

It is an object of this invention to provide a method and apparatus to increase the efficiency and/or capacity of a refrigeration system cycle.

It is another object of this invention to precisely control the economizer flow into a compressor to variably control refrigeration system capacity. These objects, and others as will become apparent hereinafter, are accomplished by the present invention.

Basically, the economizer flow to the intermediate compression volumes is controlled via a variable restriction or injection port which is optimized to maximize efficiency and/or capacity and/or to vary capacity.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
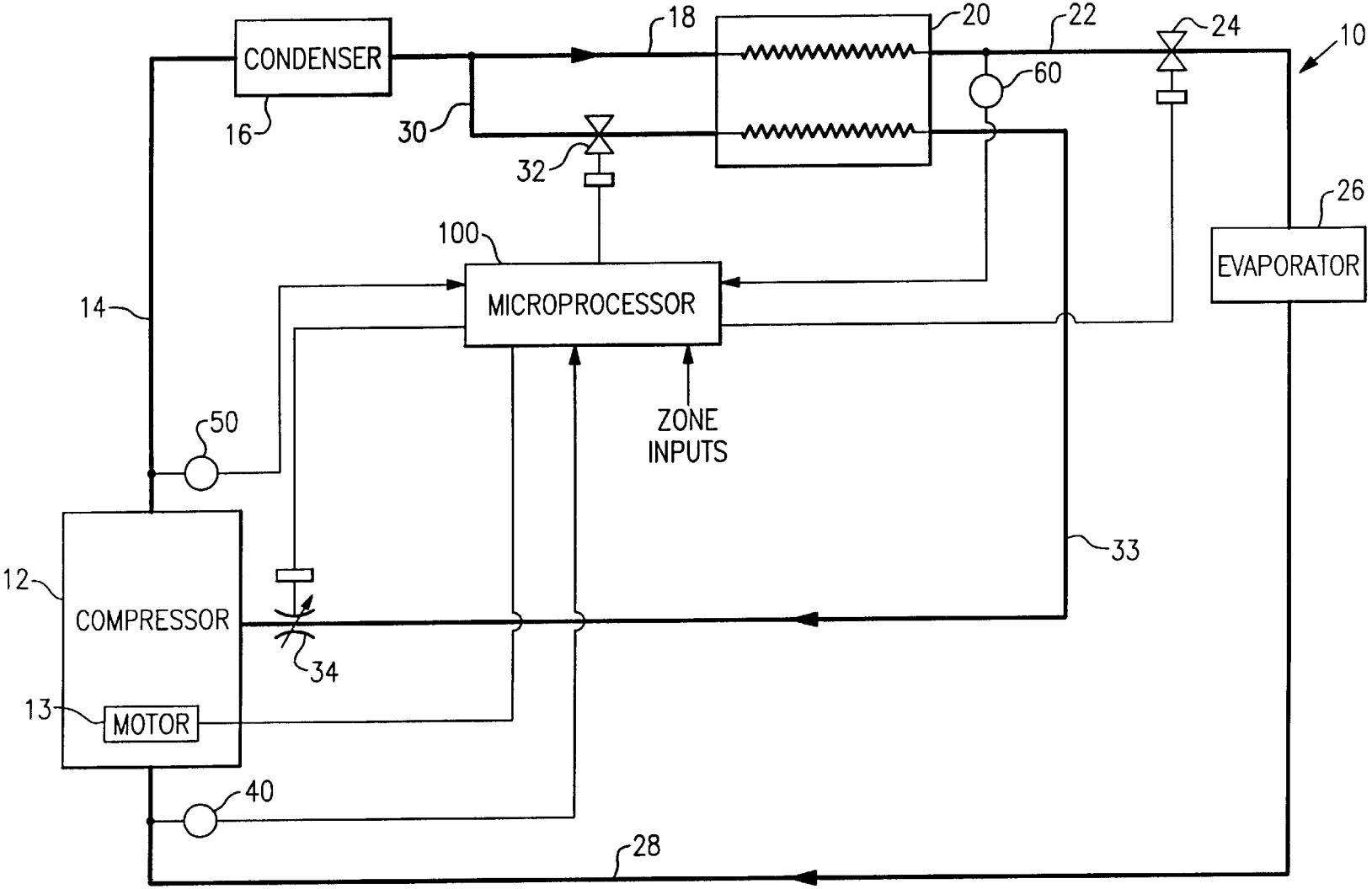
FIG. 1 is a schematic representation of a refrigeration or air conditioning system employing the present invention.

In FIG. 1, the numeral 10 generally designates a refrigeration or air conditioning system. Refrigeration or air conditioning system 10 has a compressor 12 such as a screw compressor, scroll compressor, multi-stage reciprocating compressor, a multi-stage centrifugal compressor, or an axial compressor. Refrigeration or air conditioning system 10 includes a fluid circuit serially including compressor 12, discharge line 14, condenser 16, line 18, economizer heat exchanger 20, line 22 containing expansion device 24 which is illustrated as an electronic expansion valve (EEV), evaporator 26, and suction line 28. Line 30 branches from line 18 and contains expansion device 32 which is illustrated as an EEV, passing through economizer heat exchanger 20, into line 33 containing variable restriction 34 and terminating at an intermediate compression volume (not illustrated) in compressor 12 at an intermediate pressure.

Compressor suction temperature and/or pressure data is supplied to microprocessor 100 by sensor 40 and condenser subcooling data is supplied to microprocessor 100 by sensor 60. Compressor discharge temperature and/or pressure data is supplied to microprocessor 100 by sensor 50. If necessary, or desired, other sensors can be installed to provide equivalent or alternative information for controlling system 10. Microprocessor 100 also receives data identified on FIG. 1 as "zone inputs" and would include data such as zone temperature, zone set point etc. Microprocessor 100 controls compressor 12 through motor 13 and controls EEVs 24, 32 and variable restriction 34. Except for the presence of variable restriction 34 all of the structure described is generally conventional.

In a conventional system without an economizer circuit or with variable restriction or injection port 34 being completely closed, gaseous refrigerant is drawn into compressor 12 via suction line 28 and compressed with the resultant hot, high pressure refrigerant gas being supplied via discharge line 14 to condenser 16. In condenser 16, the gaseous refrigerant condenses as it gives up heat due to heat transfer via air, water or brine-cooled heat exchangers (not illustrated). The condensed refrigerant passes from condenser 16 into line 18.

If economizer heat exchanger 20 is in operation and restriction 34 is not completely closed, a portion of the condensed refrigerant flowing in line 18 is diverted into line 30 and passes through expansion device 32 thereby undergoing a pressure drop and partially flashing as it passes into economizer heat exchanger 20. The remainder of the condensed refrigerant from condenser 16 flows via line 18 into economizer heat exchanger 20. The remaining liquid refrigerant in line 30 supplied to economizer heat exchanger 20 evaporates due to heat transfer with the liquid refrigerant in line 18 which is thereby additionally subcooled. The subcooled condensed refrigerant passes via line 22 through expansion device 24 thereby undergoing a pressure drop and partially flashing as it passes into evaporator 26. In evaporator 26, the remaining liquid refrigerant evaporates due to heat transfer via air, water or brine-cooled heat exchangers (not illustrated). The gaseous refrigerant is then supplied via suction line 28 to compressor 12 to complete the cycle. The gaseous refrigerant from economizer 20 is at an intermediate pressure and passes via line 33 to an intermediate compression volume in compressor 12. Microprocessor 100 controls compressor 12 through motor 13 and controls expansion devices 24 and 32 responsive to the data supplied by sensors 40, 50 and 60 and the zone inputs.

The foregoing is generally conventional. In a compressor, refrigerant pressure is continuously increasing inside the compression volume. Thus, during communication of refrigerant in line 33 with refrigerant in the intermediate compression volume, the communication will take place over a range of pressures/volumes in the compression process. Stated otherwise, gaseous refrigerant in line 33, at an intermediate pressure, is in fluid communication with an intermediate compression volume at a varying intermediate pressure. Since flow always is from a higher pressure to a lower pressure, flow can initially be from line 33 to the intermediate compression volume and then as pressure in the intermediate compression volume increases above that in line 33 a flow reversal can take place with flow from intermediate compression volume into line 33.

The present invention adds a variable restriction or injection port 34. The variable restriction or injection port 34 may either be in the economizer injection line 33 outside of the compressor or in the economizer passage internal to the compressor. If compressor 12 is a scroll compressor or a multi-rotor screw compressor there may be more than one economizer injection port in order to maintain a balance between different compression pockets inside the compressor, and thus more than one variable restriction may be necessary, or desired.

Figure 2:
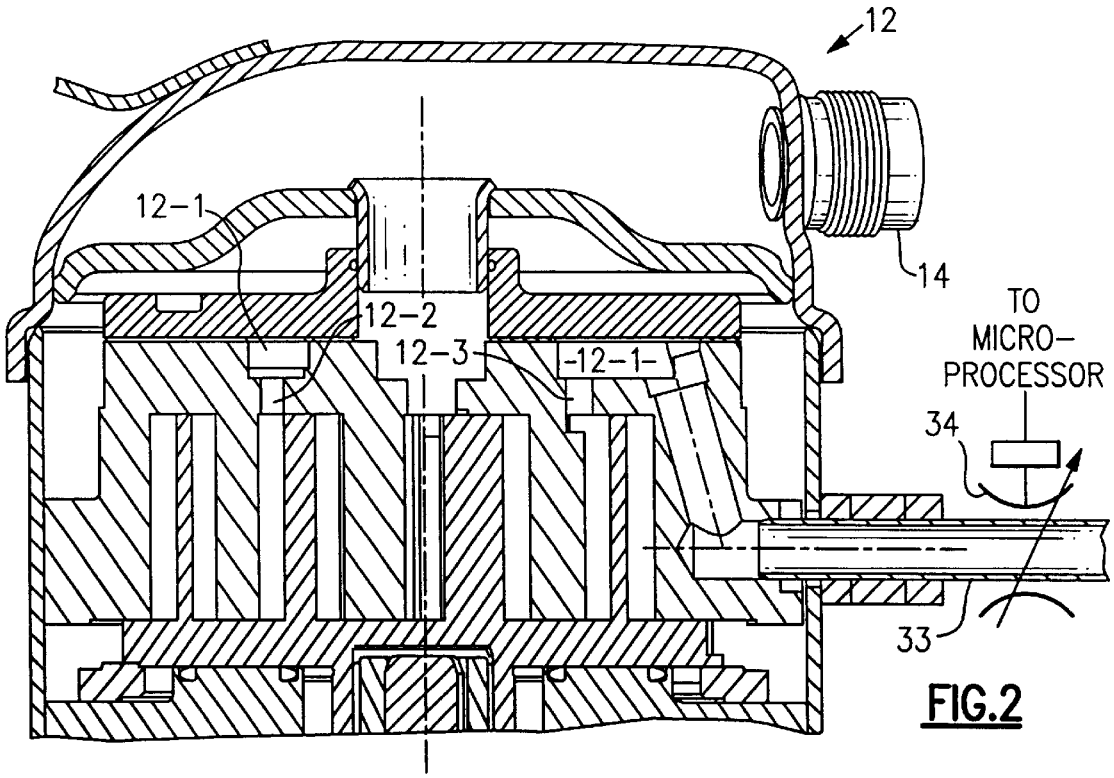
FIG. 2 is a partial sectional view of a scroll compressor employing the present invention.
Figure 3:
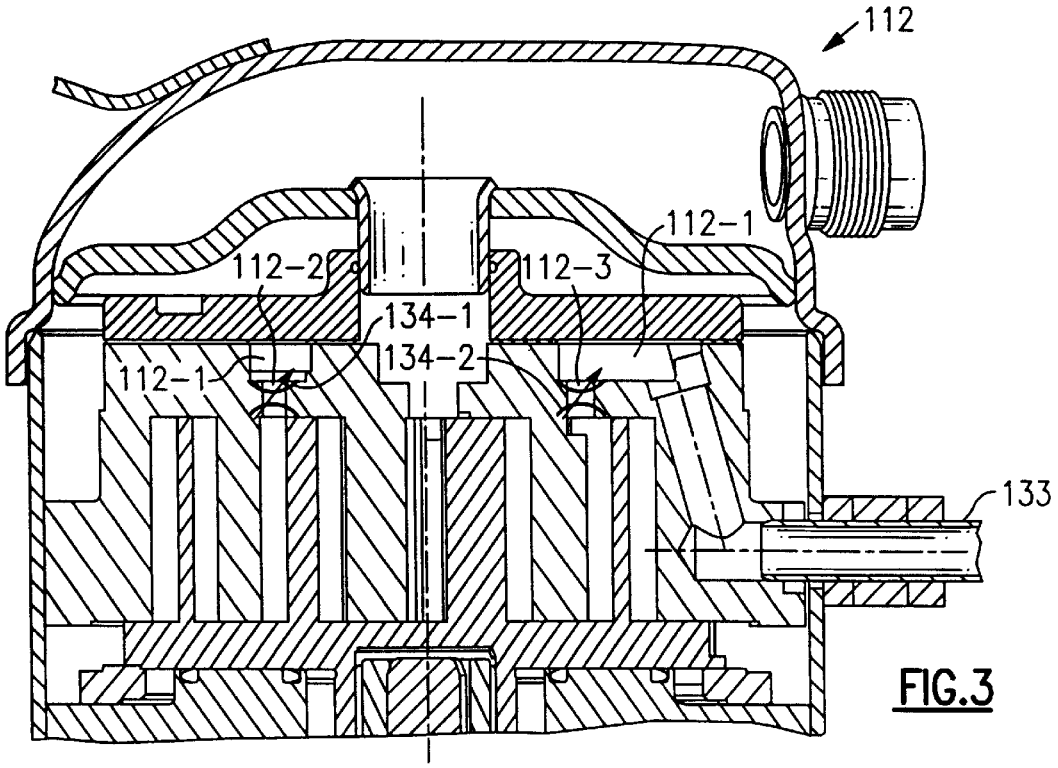
FIG. 3 is a partial sectional view of a scroll compressor employing a modification of the present invention.

Referring specifically to FIG. 2, compressor 12 is illustrated as a scroll compressor. Flow through line 33 into compressor 12 is controlled by microprocessor 100 through variable restriction 34. Flow from line 33 into compressor 12 is supplied to annular cavity 12-1 which feeds trapped volumes via passages 12-2 and 12-3, respectively. Compressor 112 of FIG. 3 differs from compressor 12 of FIG. 2 in that two variable restrictions or injection ports 134-1 and 134-2 are provided and they are located within compressor 112. Economizer flow supplied via line 133 into compressor 112 flows into annular cavity 112-1 which feeds intermediate compression volumes via passages 112-2 and 112-3 containing variable restrictions or injection ports 134-1 and 134-2, respectively. It should be understood that passages 112-2 and 112-3 are not shown to scale and their length and/or diameter may need to be increased, relative to conventional non-variable restrictions, in order to accommodate suitable commercially available variable restriction devices indicated schematically by 134-1 and 134-2. Also, variable restriction devices 134-1 and 134-2 will be connected to and controlled by microprocessor 100.

The size of the variable restriction 34 in economizer line 33 affects the efficiency of the economized cycle but the optimum restriction size of restriction 34 varies with operating conditions. For example, for higher pressure ratio applications the optimal size of restriction 34 is larger than for lower pressure ratio applications. Therefore, according to the teachings of the present invention the size of restriction 34 can be varied as a function of the compressor operating conditions to maximize the operating efficiency. The optimum size of restriction 34 for maximum capacity is larger than for maximum efficiency operation. If the restriction 34 or restrictions 134-1 and 1342 are too small for a given operating condition then the efficiency of the economized cycle is reduced. For example, in one extreme case when the restriction size is zero, or the restriction is completely closed, then there is no economized flow at all and the compressor 12, or 112, operates in a non-economized mode that is normally less efficient then the economized mode. In another extreme case where the restriction size is too large for the operating condition, the efficiency of the economized cycle is compromised because of additional flow losses associated with increased sloshing of fluid in and out of the economizer line relative to the compressor. Therefore, there is an optimum size restriction that will result in the most efficient unit operation for each set of operating conditions. Furthermore, if the goal of a designer is to maximize the unit refrigeration capacity rather than the unit efficiency, then the optimum restriction size for unit capacity would be, typically, larger than the restriction size where the unit is optimized for best efficiency. Reduction in sloshing losses has been addressed in U.S. Pat. No. 6,202,438, entitled "Compressor Economizer Circuit With Check Valve". The invention disclosed in that patent does not allow for variable capacity control. Delays associated with the opening and closing of a check valve present difficulties in operating at optimum efficiency or maximum capacity. Additionally, check valves can be noisy and leak.

Figure 4:
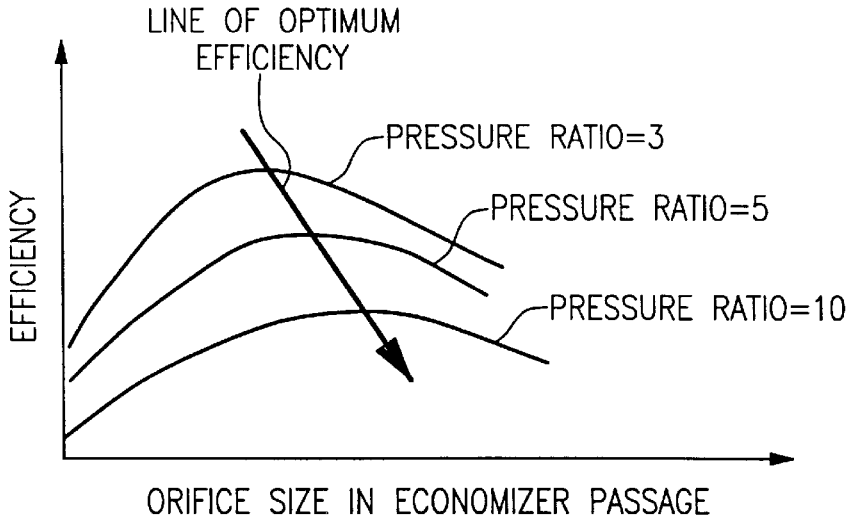
FIG. 4 is a plot of efficiency vs. orifice size for various pressure ratios.
Figure 5:
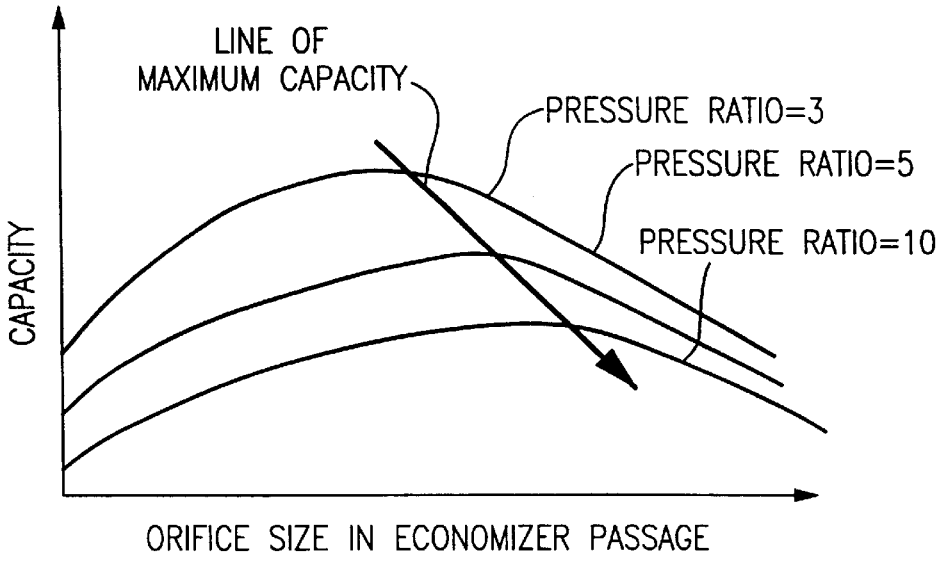
FIG. 5 is a plot of capacity vs. orifice size for various pressure ratios.

FIGS. 4 and 5 show how the efficiency and capacity of the refrigeration system is affected by the size of restriction 34 or the total size of restrictions 134-1 and 134-2.

The line that connects the efficiency maximas in FIG. 4 corresponds to optimum orifice size for the best efficiency for a given pressure ratio operation. FIG. 5 shows the line for peak capacity for given pressure ratios. The orifice size corresponding to the best efficiency and/or best capacity line can be programmed into the system control logic of microprocessor 100 for best performance. The optimum restriction orifice size varies with compressor size, the type of compressor, the operating speed, the position of the injection ports in the compression cycle, etc. Therefore, the exact shape of the curves in FIGS. 4 and 5 can only be shown in a generalized qualitative form. As an example, for a scroll compressor with 15 CFM displacement, operating at 60 Hz and with the injection ports located at a location in the compression cycle immediately after seal off from suction, the optimum size of the injection port into each compression pocket was, roughly, six square millimeters for an operating pressure ratio of five. In general, the optimum total restriction size would vary from one square millimeter to four thousand square millimeters for maximum capacity in compressors in the range of 1 CFM to 300 CFM.

Microprocessor 100 can control variable restriction 34 or variable restrictions 134-1 and 134-2 based upon sensed operating conditions. Suction pressure and/or temperature sensed by sensor 40, discharge pressure and/or temperature sensed by sensor 50 and condenser subcooling sensed by sensor 60 are suitable data inputs. In general, a higher pressure ratio and a lower condenser subcooling will require a larger orifice size for variable restriction 34 or variable restrictions 134-1 and 134-2 for optimum operation. While suction and discharge pressure can be measured directly by pressure sensors, they can be measured indirectly based on the measurements of the saturated suction and discharge temperature, respectively. For example, microprocessor 100 will be programmed for maximum efficiency or maximum unit capacity and based upon the programming and data supplied by sensors 40, 50 and 60 and zone inputs will operate as described above with the additional control of the size of restriction 34 or restrictions 134-1 and 134-2.

Although preferred embodiments of the present invention have been illustrated and described, other changes will occur to those skilled in the art. For example, the economizer can be a flush tank or economized heat exchanger, as illustrated. A pulsed valve may be used in place of the variable orifice if it can be pulsed at a sufficient rate. It is therefore intended that the scope of the present invention is to be limited only by the scope of the appended claims.

What is claimed is:

1. An economized refrigeration or air conditioning system having:

a closed fluid circuit serially including a compressor, a discharge line, a condenser, an economizer, a first expansion device, an evaporator, and a suction line leading back to said compressor;

a branch line connected to said closed fluid circuit intermediate said condenser and said economizer;

and serially including a second expansion device, said economizer, and expanding into said compressor;

means for sensing operating conditions in said refrigeration system;

means for controlling said refrigeration system responsive to sensed operating conditions;

a variable restriction for controlling the rate of flow from said branch line into said compressor, said variable restriction variable in size in response to sets of said operating conditions; and said means for controlling said refrigeration system controlling said variable restriction for controlling the rate of flow from said branch line into said compressor.

2. The economized refrigeration or air conditioning system of claim 1 wherein said means for controlling the rate of flow from said branch line into said compressor is controlled to maximize capacity in said economized refrigeration or air conditioning system.

3. The economized refrigeration or air conditioning system of claim 1 wherein said means for controlling the rate of flow from said branch line into said compressor is controlled to maximize efficiency in said economized refrigeration or air conditioning system.

4. The economized refrigeration or air conditioning system of claim 1 wherein said means for controlling the rate of flow from said branch line into said compressor is external to said compressor.

5. The economized refrigeration or air conditioning system of claim 1 wherein said means for controlling the rate of flow from said branch line into said compressor is internal to said compressor.

6. The economized refrigeration or air conditioning system of claim 5 wherein said means for controlling includes two variable restrictions.

7. The economized refrigeration or air conditioning system of claim 1 wherein said means for controlling includes two variable restrictions.

8. The system according to claim 1, wherein said variable restriction is an injection port.

9. A method of enhancing economizer cycling efficiency in a refrigeration or air conditioning system having a compressor and a line, supplying economizer flow to the compressor including the steps of:

sensing a plurality of operating conditions in the refrigeration system;

controlling economizer flow into the compressor with a variable restriction varying in size in response to sets of operating conditions.

10. The method of claim 9 where the economizer flow into the compressor is controlled to maximize compressor capacity.

11. The method of claim 9 where the economizer flow into the compressor is controlled to maximize compressor efficiency.

* * * * *